United States Patent [19]

Wissmann et al.

[11] Patent Number: 4,633,843

[45] Date of Patent: Jan. 6, 1987

[54] CARBURETOR ARRANGEMENT FOR AN INTERNAL COMBUSTION ENGINE

[75] Inventors: Michael Wissmann, Markgröningen; Harald Schliemann, Waiblingen, both of Fed. Rep. of Germany

[73] Assignee: Andreas Stihl, Waiblingen, Fed. Rep. of Germany

[21] Appl. No.: 642,757

[22] Filed: Aug. 21, 1984

[30] Foreign Application Priority Data

Aug. 27, 1983 [DE] Fed. Rep. of Germany ..... 3330994

[51] Int. Cl.[4] ..... F02M 39/00

[52] U.S. Cl. ..... 123/518; 123/463; 137/586

[58] Field of Search ..... 123/463, 516, 518, 514; 239/DIG. 68; 137/586, 587, 588

[56] References Cited

U.S. PATENT DOCUMENTS

| | | | |
|---|---|---|---|
| 1,405,147 | 1/1922 | Mueller | 137/587 |
| 3,309,608 | 3/1967 | Nierode | 261/DIG. 68 |
| 3,371,658 | 3/1968 | Turner | 261/DIG. 68 |
| 3,377,024 | 4/1968 | Nutten | 261/DIG. 68 |
| 3,610,221 | 10/1971 | Stoltman | 123/518 |
| 3,844,264 | 10/1974 | Grainger | 123/518 |
| 4,360,481 | 11/1982 | Kaufman | 261/DIG. 68 |

*Primary Examiner*—Carl Stuart Miller

*Attorney, Agent, or Firm*—Walter Ottesen

[57] ABSTRACT

The invention is directed to a carburetor arrangement for an internal combustion engine of a working tool such as a portable hand-held chain saw, a cutoff machine or the like and includes a tank from which the fuel is conducted to the main nozzle of a carburetor via an inlet valve of the carburetor. A tank pressure blocking valve is mounted in the fuel feed line between the tank and the nozzle. The valve body of the blocking valve is pressed tightly against its valve seat in the direction of fuel flow and pressure drop when the engine is at standstill. During starting and running of the engine, the valve body is lifted from its seat by the underpressure condition caused by the engine and is moved in a direction opposite to an overpressure in the tank and against the flow of fuel.

7 Claims, 3 Drawing Figures

CARBURETOR ARRANGEMENT FOR AN INTERNAL COMBUSTION ENGINE

FIELD OF THE INVENTION

The invention relates to a carburetor arrangement for an internal combustion engine of the kind utilized in power tools such as a hand-held portable chain saw, cutoff machine or the like which includes a tank from which fuel is supplied to a nozzle of a carburetor.

BACKGROUND OF THE INVENTION

Internal combustion engines which are used in motor chain saws, cutoff machines and similar hand-held portable tools are usually in the form of two-stroke engines and warm considerably during use. After the engine is turned off, the temperature can continue to rise because the cooling system is also shut down when the engine is turned off; this can cause overpressure because of fuel vaporization to develop in the tank with increased warming thereof. Because of this situation, the disadvantage occurs in practice that the inlet valve opens because of the overpressure so that fuel floods the cylinder and starting difficulties are encountered when one restarts the engine.

SUMMARY OF THE INVENTION

It is an object of the invention to provide a carburetor arrangement for an internal combustion engine wherein an overpressure which builds up in the tank is sealed off and held back when the machine is shut down and wherein a flooding of the cylinder is avoided as well as always providing an immediate start without difficulty even when the engine is hot.

The carburetor arrangement of the invention is for an internal combustion engine. The carburetor arrangement includes a tank for holding fuel and wherein overpressure can develop in response to a warming of the fuel. A carburetor having an inlet valve and nozzle means meters fuel to the engine and fuel conduit means conducts fuel in a flow direction from the tank through the inlet valve to the nozzle means. Blocking valve means is arranged in the conduit means between the tank and the nozzle means. The blocking valve means includes a structure for accommodating a segment of the conduit means; a valve seat defined by the structure and disposed in surrounding relationship to the segment; and, a valve body movably mounted in the structure for movement between a first position whereat the valve body is in contact engagement with the valve seat to block the flow of fuel through the conduit means and a second position whereat the valve body is lifted from the valve seat to allow passage of fuel through the conduit means to the nozzle means. The valve body is arranged with respect to the conduit means so as to be biased in the flow direction by the overpressure in the tank thereby causing the valve body and the valve seat to conjointly define a seal-tight blockage of the conduit means when the engine is at standstill and the overpressure is present in the tank.

Actuating means responsive to the suction underpressure of the engine during the operation thereof lifts the valve body from the valve seat to the second position in a direction opposite to the flow direction and the overpressure in the tank thereby permitting fuel to flow through the fuel conduit means to the nozzle means.

BRIEF DESCRIPTION OF THE DRAWING

The invention will now be described with reference to the drawing wherein.

DESCRIPTION OF THE PREFERRED EMBODIMENTS OF THE INVENTION

Figure 1:
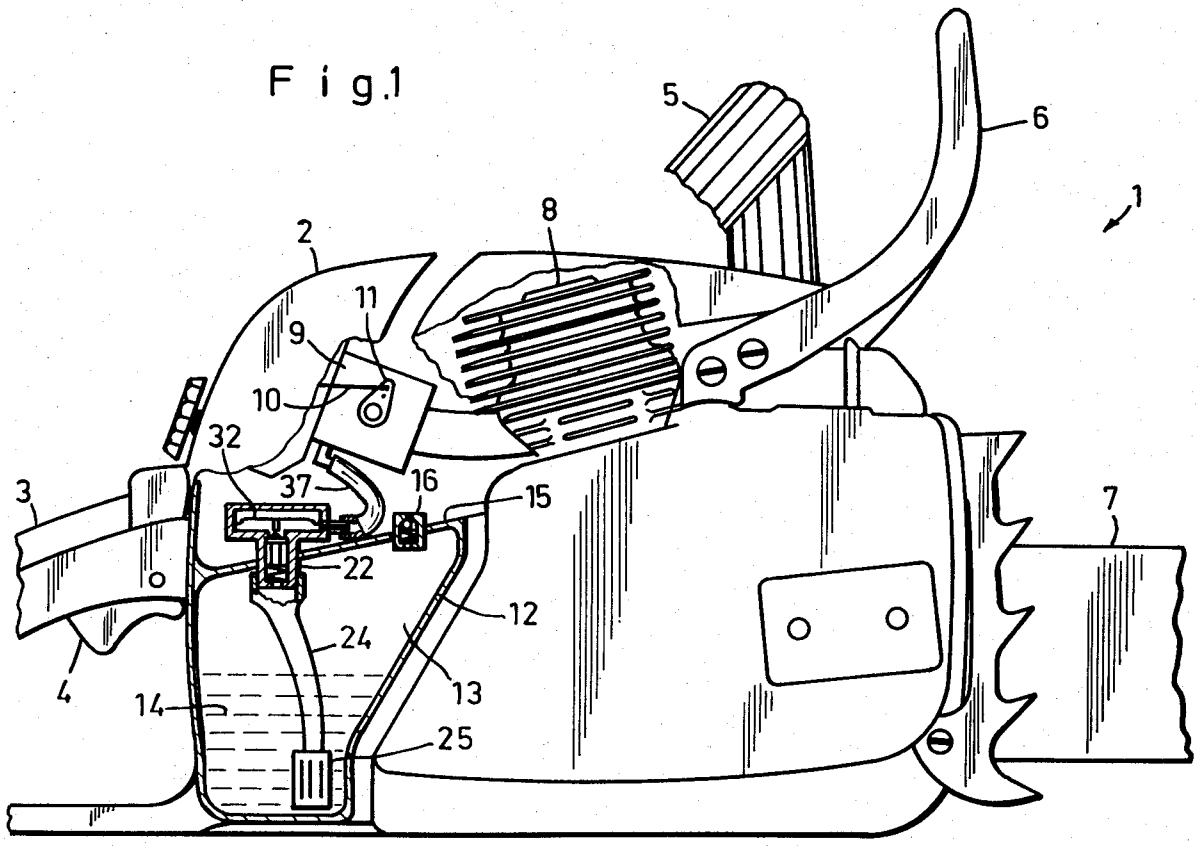
FIG. 1 is a side elevation view of a chain saw with a portion of the housing broken out to show an embodiment of a carburetor arrangement according to the invention.

Referring to FIG. 1, the chain saw 1 includes a motor housing 2, a rearward handle 3 and a throttle lever 4, a forward handle 5, a guard lever 6, a guide bar extending forwardly from the housing for guiding a saw chain (not shown) and a two-stroke internal combustion engine 8. A throttle flap lever 11 is positioned by an actuating rod 10 and is associated with the engine 8 as is a tank 12 defining an inner space 13 for the fuel 14.

Figure 2:
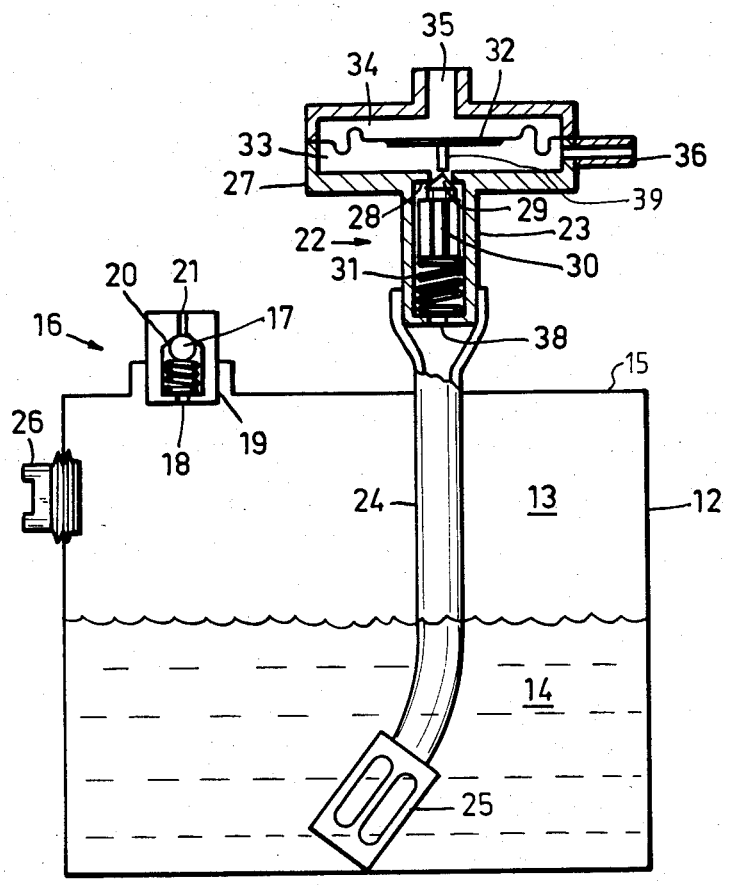
FIG. 2 is a side elevation view of a fuel overpressure tank equipped with a tank pressure blocking valve and a ventilating check valve; and, FIG. 3 is a side elevation view of another embodiment of the invention in the form of a carburetor equipped with a tank pressure blocking valve integrated therein.

Referring to FIGS. 1 and 2, a ventilating valve 16 is mounted in the upper wall 15 of the tank 12 and is configured as a check valve in such a manner that air from the ambient can enter the inner space 13 of the tank 12 and that, however, no fuel vapor can flow through the ventilating valve 16 to the ambient. For this purpose, a sealing part 17 is supported in the valve 16 and is configured as a sphere which is pressed against a funnel-like wall surface 20 of the ventilating opening 21 by a spring 18 in the housing stub 19.

The sealing part 17 is lifted from the surface 20 against the force of the spring 18 when a partial vacuum is present in the tank 12 so that the air from the ambient can enter the inner space 13 of the tank 12 through the ventilating opening 21.

A warming of the chain saw 1 is accompanied by a partial vaporization of the fuel which in turn causes an overpressure condition to develop in the tank 12 which causes the sealing part 17 to be pressed with increased force against the surface 20 so that in every instance it is assured that no fuel or fuel vapors will emanate to the ambient. In this way, the advantage is realized that there will be no undesired effects caused by fuel emanating from the tank onto the motor chain saw and its surroundings. With this blockage, a danger of fire caused by fuel running out of the tank is eliminated so that a high degree of safety is achieved especially in the case of a cutoff machine which generates sparks during operation.

In the embodiment shown in FIG. 1, a tank pressure blocking valve 22 is fixedly mounted to the wall of a valve chamber 23 in the upper wall 15 of tank 12; whereas, in the embodiment of FIG. 2, a suction tube 24 provides a tight connection to the wall 15 of the tank 12. The suction hose 24 has a basket-shaped filter 25 at its lower end located in the tank 12. The filter 25 ensures that impurities are held back and cannot get into the fuel suction system. The suction hose 24 is flaired over the wall of the valve chamber 23 and fixed so that a pressure-tight connection is provided. A filling stub 26 is provided on the side wall of the tank 12 of FIG. 2 through which the tank 12 is filled with the fuel 14.

The valve chamber 23 of the tank pressure blocking valve 22 is configured as one piece with the housing 27 so that it has a T-shape. A valve seat 28 in the form of the edge of a bore is provided at the upper end portion of the vertical leg of the T-shape. The seat 28 receives a sealing head 29 of a valve pin 30. The sealing head 29 is conically shaped and the valve pin is movable in the direction of its longitudinal axis in the valve chamber 23. The valve pin 30 is resiliently biased with a compression spring 31 which presses the valve pin 30 against the valve seat 28 so that a tight seal is provided. The valve pin 30 is pressed against the seat 28 in the direction of flow of the fuel as well as in the direction of the pressure drop from the tank 12 to the carburetor 9.

A membrane 32 is located in the housing 27 and is positioned transversely to the direction of movement of the valve pin 30. The membrane 32 partitions the housing 27 into a low pressure chamber 33 facing toward the valve pin 30 and a ventilating enclosure 34 lying on the opposite side thereof and having an opening 35 through which the ambient air enters the ventilating enclosure 34. In the embodiment of FIG. 2, the ventilating enclosure 34 is arranged on the side of the housing 27 lying opposite the valve chamber 23. Furthermore, an outlet 36 configured as a segment of a connection tube is mounted on the side of the housing 27 and communicates with the low pressure chamber 33 from which a fuel line 37 runs to the carburetor 9 as shown in FIG. 1.

An inlet opening 38 for the fuel 14 is provided on the end of the valve chamber 23 lying opposite the valve seat 28 and is located where the intake tube 24 is connected to the chamber 23.

When the internal combustion engine 8 is started, the tank pressure blocking valve 22 is opened by the partial vacuum generated by the suction action of the motor. More specifically, the membrane 32 reduces the space in the underpressure chamber 33 because of the partial vacuum caused by the suction. The membrane 32 moves in a direction against the valve pin 30 causing a pin 39 to press against the sealing head 29 thereby lifting the sealing head 29 from the valve seat 28 against the force of the compression spring 31 and against any possible overpressure present in the tank 12.

The working surface of the membrane 32 is substantially greater than the valve surface of the tank pressure blocking valve 22 so that in each instance the tank pressure blocking valve 22 will open easily and without difficulty when the engine is started. In the embodiment disclosed, the ratio of the valve surface to the membrane surface is approximately 1:100. That is, the needed underpressure to open the tank pressure blocking valve 22 is only approximately 1/100 of the counterpressure or tank overpressure. When the internal combustion engine is started, the required low partial vacuum or underpressure is easy to generate, so that, in each instance, a reliable opening of the valve is assured.

Figure 3:
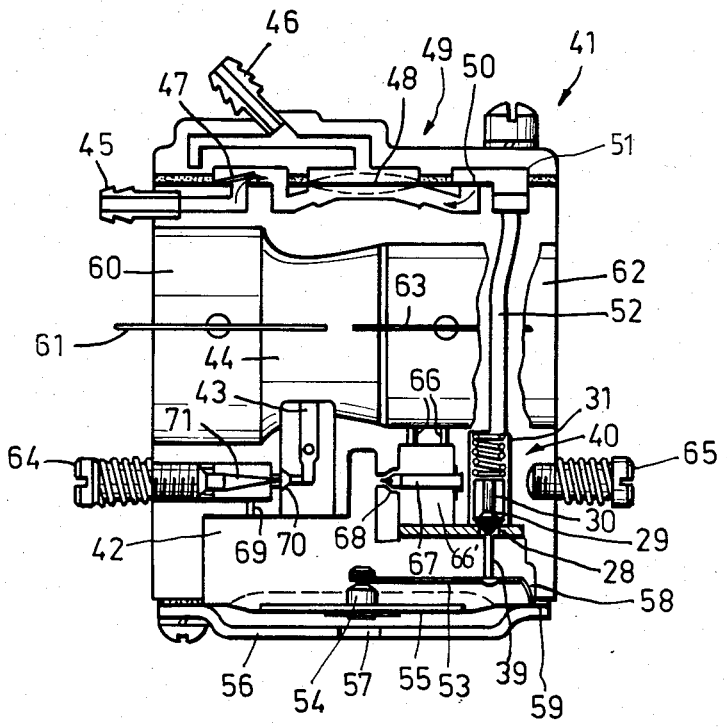

In the embodiment of the invention shown in FIG. 3, the tank pressure blocking valve 40 is integrated into the carburetor 41 so that a compact component is provided without an additional part separate therefrom. The tank pressure blocking valve 40 is configured and mounted so that it blocks fuel from entering the control chamber 42 and thereby tightly blocks off the main nozzle 43 when the engine 8 is turned off whereby the sealing of the valve 40 in the event of a possible overpressure in the tank 12 is strengthened. Accordingly, no fuel can pass through the main nozzle 43 in the venturi conduit 44 and reach the cylinder of the engine 8.

The fuel enters from tank 12 through the inlet 45 into the carburetor 41 and flows, in the presence of a partial vacuum at stub 46 from the crankcase, through the upwardly opening inlet check valve 47 because of the upwardly expanding pump membrane 48 in the control arrangement 49. When the piston of the two-cycle engine 8 moves downwardly, an overpressure condition is created in the crankcase which is directed to the pump membrane 48 via stub 46. The membrane 48 then will expand downwardly as shown by the broken line in FIG. 3. In this way, the inlet flap valve 47 is blocked so that no new fuel can flow in. At the same time, the outlet flap valve 50 of the control arrangement 49 opens upwardly because of the pressure of the pump membrane 48 so that the fuel is conducted through the angularly shaped channel 51 and into the fuel inlet conduit 52 in which the tank pressure blocking valve 40 is located.

The carburetor of FIG. 3 is shown for the condition that the motor is shutoff and the tank pressure blocking valve 40 is closed whereby the sealing head 29 of the valve pin 30 is pressed against the valve seat 28 by means of the compression spring 31 and by a possible overpressure occurring in tank 12.

The pin 39 acts against the sealing head 29 of the valve pin 30. The pin 39 is fixedly mounted to a radial lever 53 at a location to the right of the central axis 54 of the control membrane 55 which defines the lower boundary of the control chamber 42. The control membrane 55 is shielded from below by a cover 56 secured in place by threaded fasteners and having a bore 57 for equalizing pressure with respect to the ambient. The radial lever 53 has a bent over end portion 58 which is braced at the outer edge 59 of the control membrane 55 within the carburetor 41. During starting of the engine 8, an underpressure develops in the control chamber 42 and the control membrane 55 expands upwardly to take up the position shown by the broken line. In this way, the pin 39 mounted on the radial lever 53 strikes the sealing head 29 and lifts the latter in an upward direction from its valve seat 28 so that fuel can reach the main nozzle 43 through the fuel conduit 52.

As shown in FIG. 3, the carburetor 41 has an air suction channel 60 with an adjustable choke flap 61 and a mixture outlet channel 62 having an adjustable throttle flap 63. Furthermore, a spring-loaded threaded adjusting needle 64 for adjusting the main nozzle 43 and a spring-loaded positioning screw 65 for adjusting the no-load nozzle 66' are provided. The no-load nozzle 66' has two small nozzle holes 66 by means of which the latter communicates with the channel in the region of the throttle flap 63. A needle 67 arranged in the region of an inlet opening 68 of the no-load nozzle 66' is displaced with a positioning screw 65. The inlet opening 68 communicates with the control chamber 42. In addition, a channel 69 leads from the control chamber 42 and communicates with an inlet bore 70 of the main nozzle 43 having a cross-sectional opening which can be adjusted by means of the conical point 71 of the threaded adjusting needle 64.

A partial vacuum is present at the outlet of the main nozzle 43 when the two-stroke engine 8 is started and during its operation. This partial vacuum acts on the upper side of the control membrane 55 so that the latter expands upwardly to the position shown by the broken line. The pressure controlled by the membrane 55 has a substantially constant pressure difference with respect to atmospheric pressure. If a large amount of fuel is required, this means that a high flow velocity is present in the venturi tube 44 and, as a consequence thereof, a higher underpressure acts at the outlet opening 43. The larger the underpressure, the greater will be the through flow and the further the tank pressure blocking valve 40 will be opened so that more fuel can continue to flow.

The pump membrane 48 of the control arrangement 49 discussed above alternately expands upwardly and downwardly in correspondence to the pressure in the crankcase of the engine 8 in dependence upon whether the engine is in a suction or compression mode. That is, if compression takes place in the crankcase, the pump membrane 48 develops an overpressure whereby a pumping action is performed. Therefore, the membrane 48 pumps while below the sealing head 29 is lifted from its valve seat 28 via pin 39 of the tank pressure blocking valve so that fuel always flows into the control chamber 42 in correspondence to the desired quantity and the appropriate underpressure which is adjusted in the cross-section of the carburetor 41.

If an overpressure is present in the tank 12, then this overpressure passes into the carburetor 41 through input 45 thereof. The inlet flap valve 47 and the output flap valve 50 are thereby bridged or, more specifically, released since both open upwardly. If a high pressure develops in tank 12 and the tank pressure blocking valve 40 were not present, then the fuel would flow all the way into the control chamber 42 and then into the air suction channel 60 through the main nozzle 43. With the arrangement according to the invention, the overpressure of tank 12 acts with increased force on the valve pin 30 of the tank pressure blocking valve 40 so that an absolutely tight seal is obtained and no fuel can flow into the control chamber 42.

When an underpressure condition is present in the crankcase, the latter acts at stub 46 so that the pump membrane 48 expands upwardly into the position shown by the broken line whereby the volume of the chamber lying therebeneath is increased. By means of this volume increase, the right-hand outlet flap valve 50 closes whereas the left-hand inlet flap valve 47 opens as shown by the arrows in FIG. 3. Now fuel is sucked from the tank 12 which, however, can flow only as far as the pump space of the control unit 49 since the right-hand output flap valve 50 is closed. Only when the pressure of the crankcase changes and an overpressure condition is present at stub 46, which causes the pump membrane 48 to expand downwardly as shown by the broken line, will the output flap valve 50 open so that the fuel in the pump space of the control unit 49 can be conducted further along in the fuel input line 42.

When the throttle valve 63 is rotated 90° from the horizontal position shown to an approximately vertical position, both small channel bores 66 of the idle nozzle are behind the throttle flap when viewed in the direction of flow so that when the engine 8 is started, an immediate underpressure is created at the location of bores 66. This underpressure then causes the fuel to be urged through the idle system since the main nozzle 43 cannot perform this function in the idle condition because the velocity of flow in the venturi channel 44 is too low.

The arrangement according to the invention affords the special advantage that an absolute tight closure of the tank 12 is provided so that no flow of liquid or vaporized fuel can flow out of the tank independently of the inner pressure or because of the position of the chain saw 1 so that also for portable tools which generate sparks such as a cutoff machine or the like, a high degree of safety against fire is provided. In addition, the conduction of fuel in the direction of the main nozzle 43 is blocked by the tank pressure blocking valve 22, 40 immediately upon shutting off the engine.

In the event of an overpressure condition in the tank 12 caused by heating, a tight blockage of the tank pressure blocking valve 22, 40 by means of the arrangement of the invention is intensified so that a flooding of the cylinder by an excessive quantity of fuel is prevented.

When the engine 8 is started, the tank pressure blocking valve 22, 40 is opened by the pin 39 which is moved via the membrane 55 so that the fuel flows immediately and always in the correct metered quantity to the main nozzle 43. In this way, a trouble free starting of the engine whenever desired is always assured even when the motor chain saw 1 is still hot from previous use.

It is understood that the foregoing description is that of the preferred embodiments of the invention and that various changes and modifications may be made thereto without departing from the spirit and scope of the invention as defined in the appended claims.

What is claimed is:

1. A portable hand-held motor-driven chain saw, comprising:

a two-stroke internal combustion engine generating a suction underpressure during operation;

a housing for accommodating said engine therein;

a tank mounted in close proximity to said engine in said housing for holding fuel and wherein overpressure develops in response to a warming of the fuel caused by the heat developed by the engine during said operation thereof and subsequent to said operation until said engine cools down;

a carburetor having an inlet valve and nozzle means for metering fuel to the engine;

fuel conduit means for conducting fuel in a flow direction from said tank through said inlet valve to said nozzle means;

blocking valve means mounted in the wall of said tank and at an elevation above the level of the fuel in said tank and arranged in said conduit means between the fuel in said tank and said inlet valve, said blocking valve means including:

a structure for accommodating a portion of said conduit means;

a valve seat defined by said structure and disposed in surrounding relationship to said portion; and, a valve body movably mounted in said structure for movement between a first position whereat the valve body is in contact engagement with said valve seat to block the flow of fuel through said conduit means and a second position whereat said valve body is lifted from said valve seat to allow passage of fuel through said conduit means to said nozzle means, said valve body being arranged with respect to said conduit means so as to be biased in said flow direction by fuel from said tank pressed upwardly and against said valve body under the force developed by said overpressure in said tank so as to cause said valve body and said valve seat to conjointly define a seal-tight blockage of said conduit means when said engine is at standstill and said overpressure is present in said tank thereby preventing fuel from said tank from flooding the engine in response to said overpressure;

actuating means responsive to said suction underpressure of the engine during the operation thereof for lifting said valve body from said valve seat to said second position in a direction opposite to said flow direction and said overpressure in said tank thereby permitting fuel to flow through said fuel conduit means to said nozzle means;

ventilating valve means arranged in said wall of said tank for responding to an underpressure in said tank to open the same to the ambient and for responding to an overpressure in said tank for closing off the same with respect to the ambient;

said ventilating valve means being configured as a check valve and including:

a check valve housing mounted in said wall of said tank and defining a check valve seat;

a valve body movably mounted in said check valve housing for moving from a first position whereat said valve body is pressed tightly against said check valve seat for sealing off said tank from the ambient in the presence of an overpressure condition therein to a second position spaced from said check valve seat for opening said tank to the ambient in the presence of an underpressure condition therein; and, a spring mounted in said check valve housing for resiliently biasing said valve body against said check valve seat.

2. A hand-held, motor-driven chain saw comprising:

a two-stroke internal combustion engine for generating a suction underpressure during operation;

a housing for accommodating said engine therein;

a tank mounted in close proximity to said engine in said housing for holding fuel and wherein overpressure develops in response to a warming of the fuel caused by the heat developed by the engine during said operation thereof and subsequent to said operation until said engine cools down;

a carburetor connected to said fuel tank;

inlet valve means mounted in said housing and adapted for communicating with the fuel tank to admit fuel into the carburetor;

control means responsive to alternating changes in the pressure in the crankcase of the engine for pumping fuel from the fuel tank, said control means being mounted in said housing directly after said inlet valve means;

venturi means formed in said housing whereat suction underpressure is developed during the operation of the engine;

nozzle means for metering fuel into said venturi means;

fuel conduit means formed in said housing for conducting fuel in a flow direction from said control means to said nozzle means; and, blocking valve means mounted in said housing and arranged in said conduit means between said control means and said nozzle means, said blocking valve means including:

valve seat means disposed in surrounding relationship to said fuel conduit means;

a valve body movably mounted in said housing for movement between a first position whereat said valve body is in contact engagement with said valve seat means to block the flow of fuel through said conduit means and a second position whereat said valve body is lifted from said valve seat means to allow passage of fuel through said conduit means to said nozzle means, said valve body being arranged with respect to said conduit means so as to be biased in said flow direction by fuel pressed against said valve body under the force developed by said overpressure in the tank so as to cause said valve body and said valve seat means to conjointly define a seal-tight blockage of said conduit means when said engine is at standstill and said pressure is present in said tank thereby preventing fuel from said tank from flooding the engine in response to said overpressure;

actuating means mounted in said housing and responsive to said suction underpressure of the engine during the operation thereof for lifting said valve body from said valve seat to said second position in a direction opposite to said flow direction and said overpressure in said tank thereby permitting fuel to flow through said fuel conduit means to said nozzle means; and, ventilating valve means arranged in a wall of said tank for responding to an underpressure in said tank to open the same to the ambient and for responding to an overpressure in said tank for closing off the same with respect to the ambient;

said ventilating valve means being configured as a check valve and including:

a check valve housing mounted in said wall of said tank and defining a check valve seat;

a valve closure piece movably mounted in said check valve housing for moving from a first position whereat said valve closure piece is pressed tightly against said check valve seat for sealing off said tank from the ambient in the presence of an overpressure condition therein to a second position spaced from said check valve seat for opening said tank to the ambient in the presence of an underpressure condition therein; and, a spring mounted in said check valve housing for resiliently biasing said valve closure piece against said check valve seat.

3. A hand-held, motor-driven chain saw comprising:

a two-stroke internal combustion engine for generating a suction underpressure during operation;

a housing for accommodating said engine therein;

a fuel tank mounted, in close proximity to said engine in said housing for holding fuel and wherein overpressure develops in response to a warming of the fuel caused by the heat developed by the engine during said operation thereof and subsequent to said operation until said engine cools down;

a carburetor connected to said fuel tank;

inlet valve means mounted in said housing and adapted for communicating with the fuel tank to admit fuel into the carburetor;

venturi means formed in said housing whereat suction underpressure is developed during the operation of the engine;

nozzle means for metering fuel into said venturi means;

said housing having first and second housing portions disposed on opposite sides of said venturi means;

control means responsive to alternating changes in the pressure in the crankcase of the engine for pumping fuel from the fuel tank, said control means being mounted in said first housing portion of said housing next to said venturi means and directly after said inlet valve means;

fuel conduit means formed in said housing for conducting fuel in a flow direction from said control means and around said venturi means to said nozzle means; and, blocking valve means mounted in said second housing portion of said housing next to said venturi means and arranged in said conduit means between said control means and said nozzle means, said blocking valve means including:

valve seat means disposed in surrounding relationship to said fuel conduit means;

a valve body movably mounted in said housing for movement between a first position whereat said valve body is in contact engagement with said valve seat means to block the flow of fuel through said conduit means and a second position whereat said valve body is lifted from said valve seat means to allow passage of fuel through said conduit means to said nozzle means, said valve body being arranged with respect to said conduit means so as to be biased in said flow direction by fuel pressed against said valve body under the force developed by said overpressure in the tank so as to cause said valve body and said valve seat means to conjointly define a seal-tight blockage of said conduit means when said engine is at standstill and said pressure is present in said tank thereby preventing fuel from said tank from flooding the engine in response to said overpressure;

actuating means mounted in said housing and responsive to said suction underpressure of the engine during the operation thereof for lifting said valve body from said valve seat to said second position in a direction opposite to said flow direction and said overpressure in said tank thereby permitting fuel for flow through said fuel conduit means to said nozzle means; and, ventilating valve means arranged in a wall of said tank for responding to an underpressure in said tank to open the same to the ambient and for responding to an overpressure in said tank for closing off the same with respect to the ambient;

said ventilating valve means being configured as a check valve and including:

a check valve housing mounted in said wall of said tank and defining a check valve seat;

a valve closure piece movably mounted in said check valve housing for moving from a first position whereat said valve closure piece is pressed tightly against said check valve seat for sealing off said tank from the ambient in the presence of an overpressure condition therein to a second position spaced from said check valve seat for opening said tank to the ambient in the presence of an underpressure condition therein; and, a spring mounted in said check valve housing for resiliently biasing said valve closure piece against said check valve seat.

4. The carburetor of claim 2, said blocking valve means including resilient means for resiliently biasing said valve body into said first position and against said valve seat means.

5. The carburetor of claim 4, said valve body having a pressure contact surface formed thereon so as to face toward said inlet valve means, said resilient means being a compression spring arranged in said housing so as to be in contact engagement with said valve body at said pressure contact surface for resiliently biasing the same against said valve seat means.

6. The carburetor of claim 4, said housing defining an enclosure, said actuating means including: a membrane partitioning said enclosure into a ventilating compartment communicating with the ambient and a low-pressure chamber communicating with said air intake means through said nozzle means; and, an actuating pin mounted on said membrane in said low-pressure chamber directly adjacent said valve body; said membrane being mounted in said enclosure for movement toward said valve body in response to said suction underpressure so as to permit said actuating pin to strike said valve body and lift the same from said valve seat thereby permitting fuel to flow toward said nozzle means.

7. The carburetor of claim 6, said actuating means further including a lever attached at one end thereof to said membrane at the center of the latter and extending radially therefrom so as to be braced with the other end thereof at the edge of said membrane thereby permitting movement of said lever with said membrane toward said valve body; and, said actuating pin being mounted on said lever so as to be in alignment with said valve body for striking the latter in response to said movement by said membrane.

* * * * *

UNITED STATES PATENT AND TRADEMARK OFFICE

CERTIFICATE OF CORRECTION

PATENT NO. : 4,633,843

DATED : January 6, 1987

INVENTOR(S) : Michael Wissmann et al

It is certified that error appears in the above-identified patent and that said Letters Patent is hereby corrected as shown below:

In column 4, line 20: delete "shutoff" and substitute -- shut off -- therefor.

In column 9, line 37: delete "for" and substitute -- to -- therefor.

Signed and Sealed this

Sixth Day of October, 1987

*Attest:*

DONALD J. QUIGG

*Attesting Officer*

*Commissioner of Patents and Trademarks*